US008820381B2

(12) United States Patent
Hoffman et al.

(10) Patent No.: US 8,820,381 B2
(45) Date of Patent: Sep. 2, 2014

(54) APPARATUS AND METHOD FOR TIN-TIE APPLICATION

(75) Inventors: Karl K. Hoffman, Arlington Heights, IL (US); Tom Roberts, Bolingbrook, IL (US); Steve Kaganovich, Northbrook, IL (US); Clay Ladd, Lafayette, NJ (US); Arthur A. Sagy, Guttenberg, NJ (US)

(73) Assignee: Plitek L.L.C., Des Plaines, IL (US)

( * ) Notice: Subject to any disclaimer, the term of this patent is extended or adjusted under 35 U.S.C. 154(b) by 0 days.

(21) Appl. No.: 13/435,808

(22) Filed: Mar. 30, 2012

(65) Prior Publication Data

US 2012/0247346 A1 Oct. 4, 2012

Related U.S. Application Data

(60) Provisional application No. 61/516,229, filed on Mar. 31, 2011.

(51) Int. Cl.

| | |
|---|---|
| ***B29C 65/48*** | (2006.01) |
| ***B32B 37/10*** | (2006.01) |
| ***B65H 37/00*** | (2006.01) |
| ***B65H 29/54*** | (2006.01) |
| ***B65H 43/00*** | (2006.01) |
| ***B30B 9/30*** | (2006.01) |
| ***B30B 9/32*** | (2006.01) |
| ***B65B 9/20*** | (2012.01) |
| ***B65B 61/20*** | (2006.01) |

(52) U.S. Cl.

CPC ..... *B30B 9/321* (2013.01); *B30B 9/3014* (2013.01); *B65B 9/20* (2013.01); *B65B 61/202* (2013.01)

USPC ..... 156/537; 156/540; 156/556; 156/581; 156/764

(58) Field of Classification Search

USPC ..... 156/247, 249, 289, 701, 719, 537–540, 156/556, 580, 581, 764, 766, 767

See application file for complete search history.

(56) References Cited

U.S. PATENT DOCUMENTS

| | | | |
|---|---|---|---|
| 331,357 | A | 12/1885 | Wineberger |
| 907,492 | A | 12/1908 | Graser |
| 2,017,704 | A | 10/1935 | Rose |
| 2,138,066 | A | 11/1938 | Machett |
| 2,159,976 | A | 5/1939 | Machett |
| 3,534,520 | A | 10/1970 | Moran |
| 3,545,668 | A | 12/1970 | Hultberg |
| 3,825,039 | A | 7/1974 | Crabb |
| 3,890,190 | A | 6/1975 | Eburn, Jr. et al. |
| 3,895,989 | A | 7/1975 | Lucas |

(Continued)

*Primary Examiner* — Sing P Chan
(74) *Attorney, Agent, or Firm* — John S. Pacocha

(57) ABSTRACT

A system for applying a tin-tie, from a supply of tin-ties releaseably adhered along the length of a liner, with the tin-tie length generally aligned along a length of packaging moving in a first direction includes a tamp applicator for extending and retracting along a second direction substantially transverse to the first direction. The tamp applicator includes a magnet for carrying the tin-tie after it is released from the liner by a peeler, an air assist for aid in releasing and positioning the tin-tie, and a recess and edge for positioning the tin-tie. Part of the tamp applicator carrying the released tin-tie is also moveable in the same first direction, allowing travel in the same first direction as the moving packaging material when putting the tin-tie on the moving packaging material. A spring biases the part to return in a third direction opposite the first direction.

20 Claims, 6 Drawing Sheets

(56) References Cited

U.S. PATENT DOCUMENTS

| | | | | | |
|---|---|---|---|---|---|
| 3,919,829 | A | | 11/1975 | Burford et al. | |
| 4,025,382 | A | * | 5/1977 | Del Rosso | 156/497 |
| 4,394,955 | A | | 7/1983 | Raines et al. | |
| 4,420,355 | A | | 12/1983 | Saur | |
| 4,490,960 | A | | 1/1985 | Klemesrud | |
| 4,559,766 | A | | 12/1985 | Matsushita | |
| 4,559,977 | A | | 12/1985 | Dilley | |
| 4,586,412 | A | | 5/1986 | Johnson | |
| 4,655,264 | A | | 4/1987 | Dilley | |
| 4,660,351 | A | | 4/1987 | Saitoh | |
| 4,696,244 | A | | 9/1987 | Sampson et al. | |
| 4,730,434 | A | | 3/1988 | Knudsen | |
| 4,818,120 | A | | 4/1989 | Addiego | |
| 5,045,042 | A | | 9/1991 | Rutledge | |
| 5,121,682 | A | | 6/1992 | Parker et al. | |
| 5,215,797 | A | | 6/1993 | Larsen et al. | |
| 5,227,210 | A | | 7/1993 | Larsen et al. | |
| 5,302,222 | A | | 4/1994 | Larsen et al. | |
| 5,328,436 | A | | 7/1994 | Larsen et al. | |
| 5,389,190 | A | | 2/1995 | Larsen et al. | |
| 5,390,473 | A | | 2/1995 | Nelson et al. | |
| 5,402,619 | A | | 4/1995 | Nelson et al. | |
| 5,916,108 | A | | 6/1999 | Drietz | |
| 5,941,641 | A | | 8/1999 | Kinigakis et al. | |
| 6,453,967 | B1 | | 9/2002 | DiFabio et al. | |
| 6,824,629 | B2 | | 11/2004 | DiFabio et al. | |

* cited by examiner

APPARATUS AND METHOD FOR TIN-TIE APPLICATION

RELATED APPLICATION

This application is based on, and claims benefit of, U.S. Provisional Application No. 61/516,229, filed Mar. 31, 2011.

BACKGROUND OF THE INVENTION

1. Field of the Invention

This invention relates generally to the application of tin-ties to packaging, and an improved apparatus and method for the application of tin-ties.

2. Background Art

Ties such as twist-ties or tin-ties generally comprise one or more pieces of malleable, magnetic metal, such as a wire or ribbon, with the length of the metal covered by paper or plastic. Such ties are often used by consumers to close or reclose flexible bags. Sometimes the ties are provided separately to be later attached to the packaging by the consumer. At other times, the ties are attached to packaging, such as a bag of coffee, by the manufacturer or packager of the product. A method of manufacture of such ties is to make, such as by extrusion, a continuous length of tie material and then cut individual ties to the desired lengths. Such prior art ties have the ends of the metal exposed immediately adjacent the ends of the tie, which may cause a puncture in the bag or present a hazard to the user.

Kinigakis, et al U.S. Pat. No. 5,941,641 issued Aug. 24, 1999 discloses a wrap around recloseable pouch with a tin-tie or deadfold strip attached to a flexible flap of a pouch. The deadfold strip is generally aligned along the length of the open pouch, and is used to reclose the pouch after a portion of its contents have been consumed. Larsen et al U.S. Pat. No. 5,215,797 issued Jun. 1, 1993 and U.S. Pat. No. 5,328,436 issued Jul. 12, 1994 disclose a deadfold strip for hand pressure attachment in a vertical or lengthwise orientation on a bag, generally perpendicular to the bag mouth, to facilitate reclosure of the partially consumed contents.

Larsen et al U.S. Pat. No. 5,227,210 issued Jul. 13, 1993 and U.S. Pat. No. 5,302,222 issued Apr. 12, 1994 disclose a dispensing roll of deadfold stickers on a length carrier tape with each sticker having at least two deadfold wires in spaced parallel alignment transverse to the length of the tape. The stickers are peeled off the tape and adhered onto an unfilled, flatted condition bag, perpendicular to the bag mouth. The sticker and at least the area of the bag wall covered by the sticker are passed between pressure rollers.

Nelson, et al U.S. Pat. No. 5,390,473 issued Feb. 21, 1995 and U.S. Pat. No. 5,402,619 issued Apr. 4, 1995 disclose a tin-tie applied across the width of a bag, generally parallel to the bag mouth, and bent to seal the bag. A magnetic head is used for positioning the bag after the tin-tie is attached to the bag. Larsen, et al U.S. Pat. No. 5,389,190 issued Feb. 14, 1995 discloses a twist-tie applicator in which a continuous length of twist tie material is extracted, cut to a desired length, removed with a magnetic attraction mechanism and then adhesively secured to a container. In Drietz, et al U.S. Pat. No.5,916,108 issued Jun. 29, 1999 a magnetic attracting mechanism facilitates manipulation of a tie fastener that is fastened on an article. DiFabio, et al. U.S. Pat. No. 6,453,967 issued Sep. 24, 2002 and U.S. Pat. No. 6,824,629 issued Nov. 30, 2004 discloses applying twist-ties to formed bags held at a station by spraying glue onto a twist-tie as it is advanced onto a carrier which pivots to a position orienting glued face of the twist-tie facing the bag held at the station and then moves in a horizontal direction to carry the twist-tie into engagement with the bag held at the station to secure the twist-tie on the bag. The carrier includes an air jet to aid in the release of the twist-tie from the magnetic holding of the carrier.

There remains a need for a tie-tie applicator for self-adhering tin-ties that are precut to a selected length and supplied transversely on a carrier liner for removal from the liner just prior to applying the tin-ties lengthwise on a moving web of packaging material. More particularly, there remains a need for application of such tin-ties during a continuous packaging process, after the packaging containers are formed and are being filled with the product.

SUMMARY OF THE INVENTION

The present invention is concerned with providing a system for applying a tin-tie to a length of packaging capable of moving in a first direction in a packaging process including a peeler for removing a tin-tie from a supply of adhesive backed tin-ties releaseably adhered along a length of liner. A tamp applicator capable of extending and retracting along a second direction substantially transverse to the first direction of movement of the length of the packaging material is capable of carrying the released tin-tie for application to the moving packaging material. The tamp applicator may include a magnet for carrying the released tin-tie. A tube, capable of carrying compressed air, may be positioned adjacent the peeler and the tamp applicator, the tube having a plurality of openings for directing compressed air to assist in releasing a tin-tie from the liner and positioning the tin-tie on the applicator. The tamp applicator may also include a recess and edge for aligning the released tin-tie. A portion of the tamp applicator carrying the released tin-tie is also moveable in the same first direction of movement of the length of the packaging material. The portion of the tamp applicator capable of carrying the released tin-tie that is also moveable in the same first direction of movement of the length of the packaging material may include a spring biasing the portion to return in a third direction opposite to the first direction. The portion of the tamp applicator capable of carrying the released tin-tie that is also moveable in the same first direction of movement of the length of the packaging material may be carried by a piece that is capable of extending and retracting in the second direction substantially transverse to the first direction of movement of the length of the packaging material. The portion of the tamp applicator capable of carrying the released tin-tie that is also moveable in the same first direction of movement of the length of the packaging material may be carried by the piece that is capable of extending and retracting in the second direction substantially transverse to the first direction of movement of the length of the packaging material by a rib and attached rod that are secured to one of the piece or portion and received in a slot in the other of the portion or piece.

The present invention is also concerned with providing a system for applying an adhesive backed attachment to a moving packaging material during a packaging process. A length of liner has a supply of the adhesive backed attachments releaseably adhered along the length of the liner. There is a peeler for removing an adhesive backed attachment from the liner. A tamp applicator, including a portion capable of carrying the released adhesive backed attachment removed from the liner, is capable of extending and retracting along a second direction substantially transverse to the first direction of movement of the length of the packaging material, and the portion of the tamp applicator capable of carrying the adhesive backed attachment is also moveable in the same first direction of movement of the length of the packaging material. The portion of the tamp applicator capable of carrying the adhesive backed attachment removed from the liner that is also moveable in the same first direction of movement of the length of the packaging material may include a spring biasing the portion to return in a third direction opposite to the first direction. The portion of the tamp applicator capable of carrying the adhesive backed attachment removed from the liner that is also moveable in the same first direction of movement of the length of the packaging material may be carried for such movement in the same first direction by a piece that extends and retracts in the second direction substantially transverse to the first direction of movement of the length of the packaging material. The portion of the tamp applicator capable of carrying the adhesive backed attachment removed from the liner that is also moveable in the same first direction of movement of the length of the packaging material may be carried for such movement in the same first direction by the piece that extends and retracts in the second direction substantially transverse to the first direction of movement of the length of the packaging material by a rib and attached rod that are secured to one of the piece or portion and received in a slot in the other of the portion or piece.

The present invention also is concerned with providing a method for applying a tin-tie to a length of packaging material moving in a first direction during a packaging process including the steps of peeling a tin-tie having a length from a length of liner on which a supply of tin-ties with an adhesive on one side are releaseably adhered, with the length of each tin-tie transverse to the length of the liner, positioning the peeled tin-tie on an applicator head with the adhesive away from the applicator head, pushing the applicator head in a second direction transverse to the first direction toward the moving packaging material, and putting the peeled tin-tie on the moving packaging material with the length of the tin-tie aligned in the first direction. The method may include a step of picking up the peeled tin-tie with a magnetic applicator head. Positioning the tin-tie may also include the step of positioning the tin-tie in a recess or against an edge. The method may include a step of allowing the applicator head to travel in the same first direction as the moving packaging material when putting the peeled tin-tie on the moving packaging material. The method may further include a step of returning the applicator head in a third direction opposite the first direction.

BRIEF DESCRIPTION OF THE DRAWINGS

For a better understanding of the present invention, reference may be had to the accompanying drawings in which.

DETAILED DESCRIPTION

Figure 1:
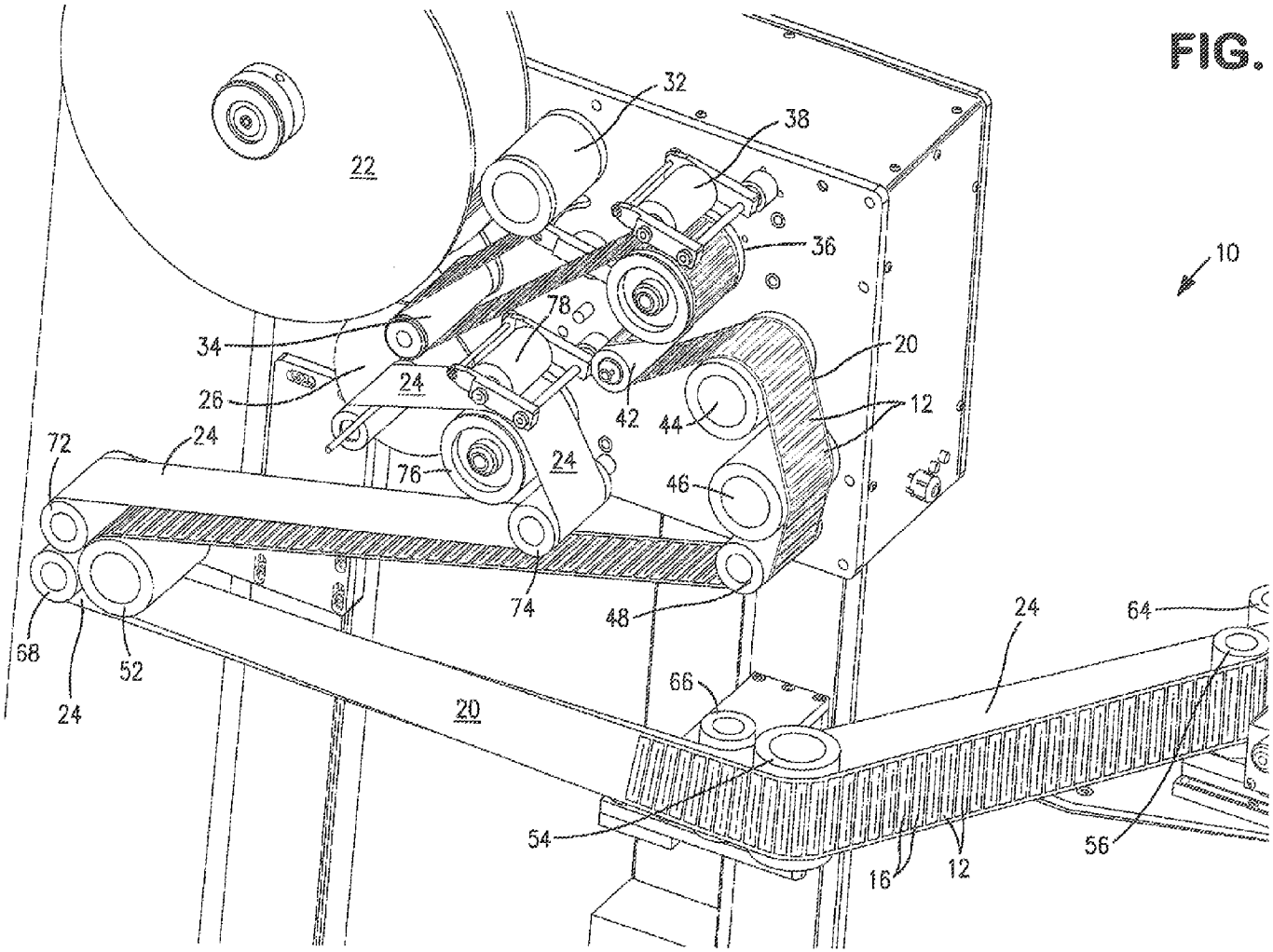
FIG. 1 is a perspective view of a portion of a tin-tie applicator of the present invention, showing the tin-tie supply and empty take-up.
Figure 2:
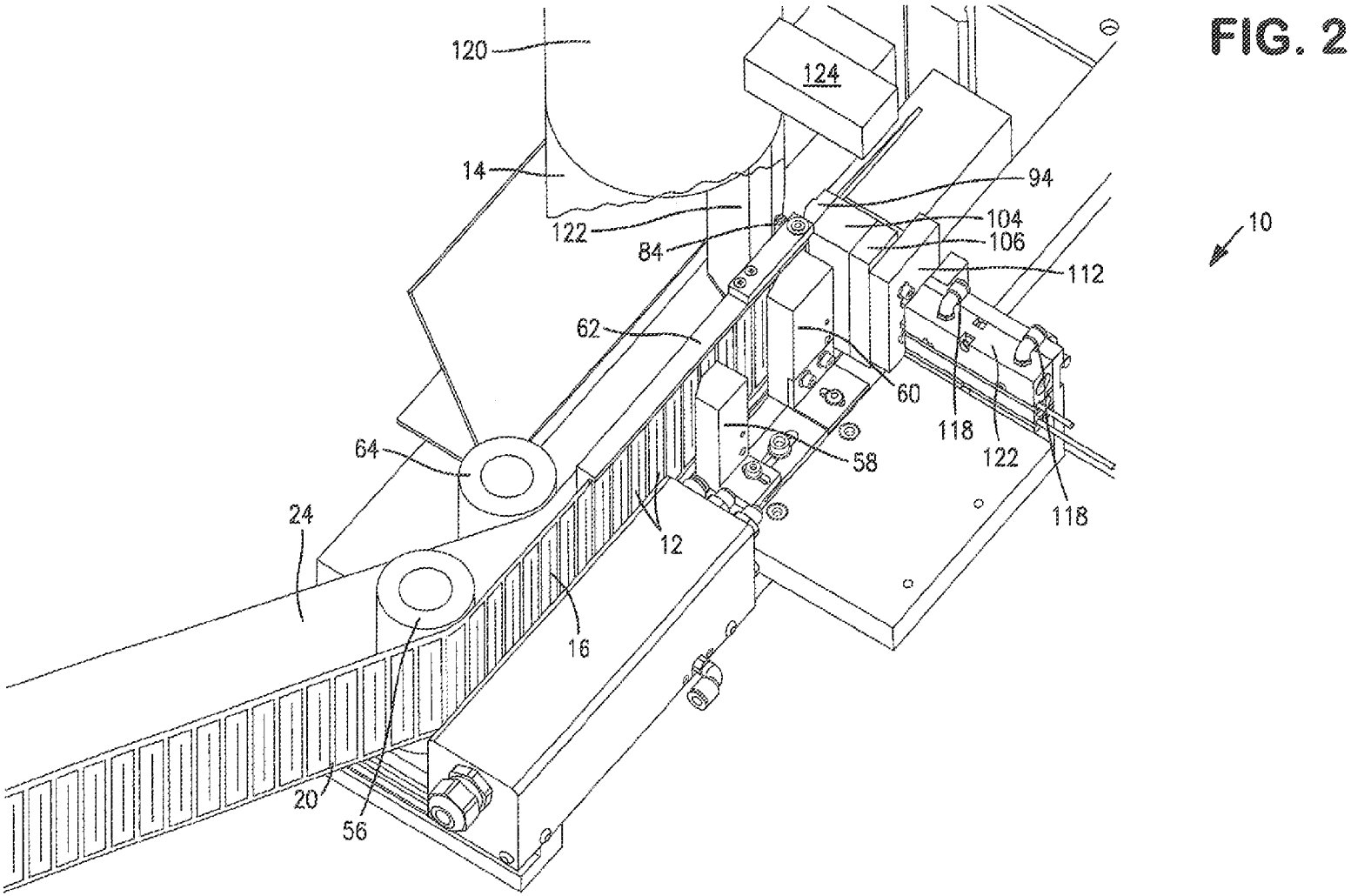
FIG. 2 is perspective view of another portion of the tin-tie applicator of the present invention, showing the applicator unit.

The present invention relates to the field of applying tin-ties to product packaging. FIGS. 1 and 2 generally illustrate a system 10 for applying tin-ties 12 to product packaging 14, as part of a continuous vertical form, fill and seal packaging machine. System 10 may be attached to a vertical or horizontal form, fill and seal packaging machine for the application of tin-ties 12 so that the length of the tin-tie is generally parallel to the length of the product packaging. Although illustrated in the drawings with respect to a vertical form, fill and seal line, it will be apparent that it may be reoriented with respect to a horizontal line. Such an application of a tin-tie facilitates re-closure of the packaging after it has been opened by the customer and partially consumed.

Tin-ties 12 are not shown in detail, however they generally comprise at least one piece of malleable, magnetic metal, such as a wire or ribbon 16, with the length of the metal sandwiched between, and covered by, top and bottom layers or pieces of paper or plastic that are held together by an adhesive. The tin-ties also have an adhesive 18 on the back side, more particularly on the exposed side of the bottom piece of paper or plastic.

Each tin-tie 12 is releasably adhered on top of release liner 20 by an adhesive 18, which has less adhesive, or peel, strength than adhesive(s) keeping the wire or ribbon 16 sandwiched between cover layers. Adhesive 18 may be a silicon, rubber, acrylic or ethylene-vinyl acetate (EVA) based pressure sensitive adhesive, which is preferred, or it may be a thermal bond film. As the force of adhesion between tin-tie 12 and liner 20 will be less than the force of adhesion between the parts or layers of tin-tie 12, a tin-tie 12 may be removed from liner 20 without taking the tin-tie apart. The force of adhesion of adhesive 18 is strong enough to carry a tin-tie 12 on the release liner until it is removed from the release liner by an applied force for application to the packaging 14 immediately prior to the application to the packaging. Adhesive 18 then more permanently affixes the tin-ties to packaging 14. The adhesive may be applied on the entire back side of the tin-tie, or a may be applied in strips or some other pattern, as long as there is sufficient adhesive to releaseably adhere the tin-tie to the transporting release liner for stable progression during the process until it is removed from the liner with a force to then allow for application and adhesion to the packaging.

Liner 20 may conveniently be a long length of non-tearing polyester provided with a silicon coating on one, or both, surfaces. The coating may be applied to the entire surface or may be applied in strips or some other pattern that facilitates removal of the tin-tie from the liner. Other siliconized substrates may also be used for the release liner, such as, a super calendared kraft paper, a glassine material, a clay coated kraft paper, a machine finished kraft paper, a machine glazed paper, or a biaxially oriented polypropylene. Non-silicoized substrates with low surface tension, such as high density polyesters, low density polyesters and poly ester plastic resins may also be used as a release liner. Tin-ties 12 are supplied on liner 20 with the length of each tin-tie generally transverse to the length of liner 20. FIG. 1 shows a roll or reel 22 of liner 20 and a plurality of tin-ties 12. Some of the tin-ties are omitted from release liner 20 for ease of illustration.

In addition to liner 20 carrying tin-ties 12, liner 20 is also shown empty in FIGS. 1 and 2, after tin-ties 12 have been removed and applied to packaging 14, as empty liner 24.

Release liner 20 carrying tin-ties 12 and empty liner 24 are actually the same liner; however, particularly as some of tin-ties 12 have been omitted for ease of illustration, the empty liner is separately designated by reference numeral 24 for clarity. It will be appreciated that both release liner 20 with tin-ties 12 and empty liner 24 are one continuous strip of the same material. As is shown in FIG. 1, empty liner 24 is taken up on a rewinder, or empty spool, 26 after the tin-ties have been applied to the packaging.

System 10 provides for unwinding release liner 20 with tin-ties 12 from reel 22. More particularly, as is best shown in FIG. 1, liner 20 with tin-ties 12 passes over guide roller 32, roller 34 of a biased dancer arm to maintain proper tension, and is advanced by servo driven roller 36 with nip roller 38. The liner and tin-ties then pass around roller 42 of another biased dancer arm and over, generally changing direction of liner 20 from vertical to horizontal. Release liner 20 with tin-ties 12 then passes around guide roller 52 to again change its direction, and then around generally vertically aligned roller 54 to change the orientation of the liner and tin-ties. In FIG. 1, as liner 20 comes around roller 52 it is the underside of the liner (without tin-ties 12) that is visible; liner 20 then twists around 90 degrees as it approaches roller 54 where tin-ties 12 are visible. For ease of illustration, some of the tin-ties are not shown on the liner as it twists around in FIG. 1.

Liner 20 then passes around guide roller 56 and past spaced apart sensors 58 and 60, as is best shown in FIG. 2. Application of tin-ties with the present invention is operated by a programmable logic controller ("PLC") (not shown), which co-operates with the controls for the packaging line. Sensors 58 and 60 detect the beginning and end of each tin-tie 12 and control the dispensing of the tin-ties in combination with the PLC and controls for the packaging line. The changes of direction and the change or twist of the orientation of release liner 20 with tin-ties 12 illustrated in FIG. 1 accommodate a small format applicator. In the particular embodiment illustrated, larger diameter rollers, particularly roller 54, aid in preventing premature separation or dispensing of the tin-ties from the release liner. In another packaging environment, the particular configuration of rollers may be different. However, it is necessary to properly support the liner 20 with tin-ties 12 to prevent premature separation or dispensing of the tin-ties. In any configuration, some combination of guide or support rollers, drive rollers and tensioning mechanism(s) is needed. All of the rollers should be of a low surface energy material such as high density polyethylene or be silicone coated to reduce inadvertent build-up of adhesive 18 on the rollers.

Liner 20 passes around peeler bar 62, tin-ties 12 are separated from liner 20, and the resulting empty liner 24 is returned to the rewinder take-up spool 26. More particularly, empty liner 24 passes, in a generally vertical orientation, around guide rollers 64 and 66. When empty liner 24 next passes over guide rollers 68 and 70, the direction of the empty liner is reversed. Finally, empty liner 24 passes over guide roller 74, through servo driven roller 76 and nip roller 78, and is taken up by rewinder 26.

Figure 3:
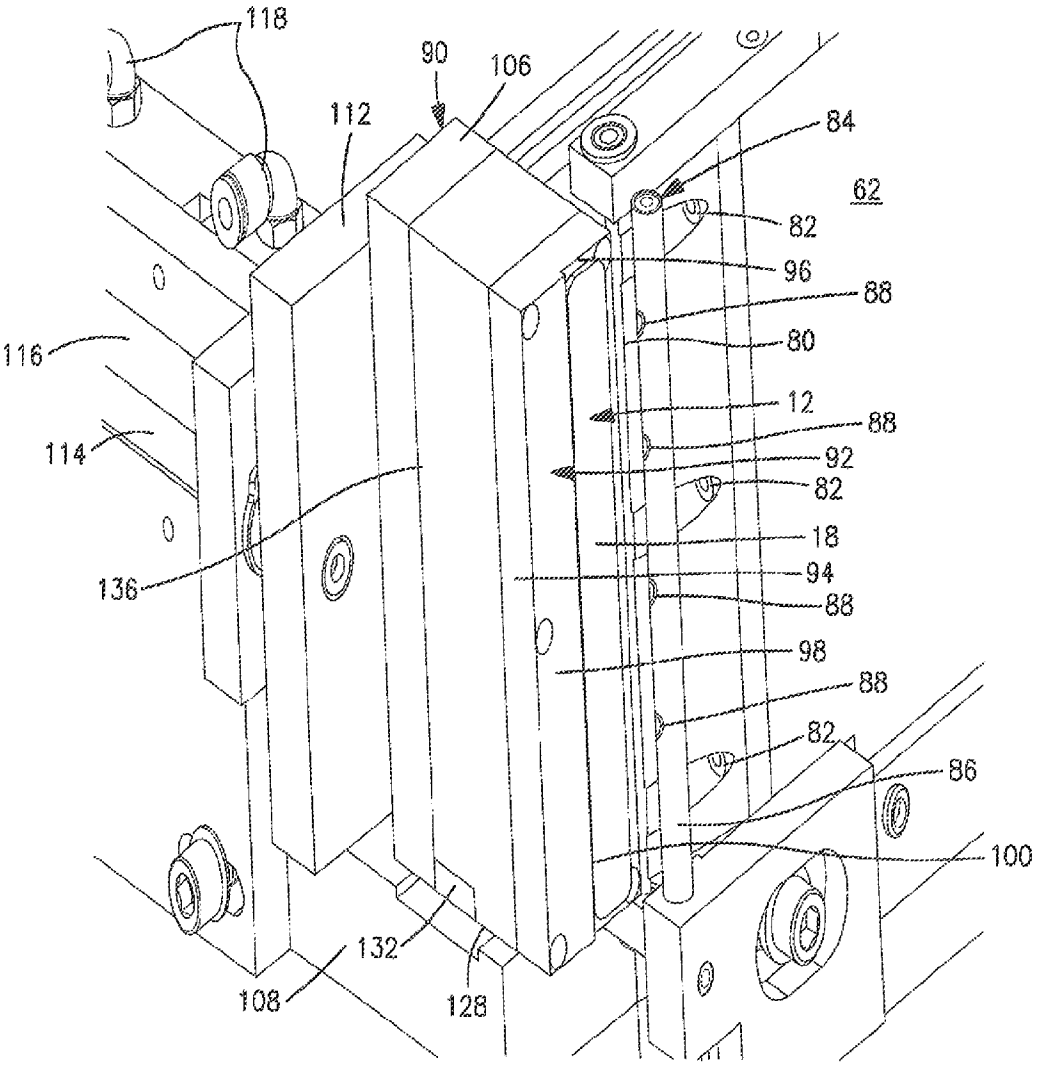
FIG. 3 is an enlarged perspective view showing the applicator unit.
Figure 4:
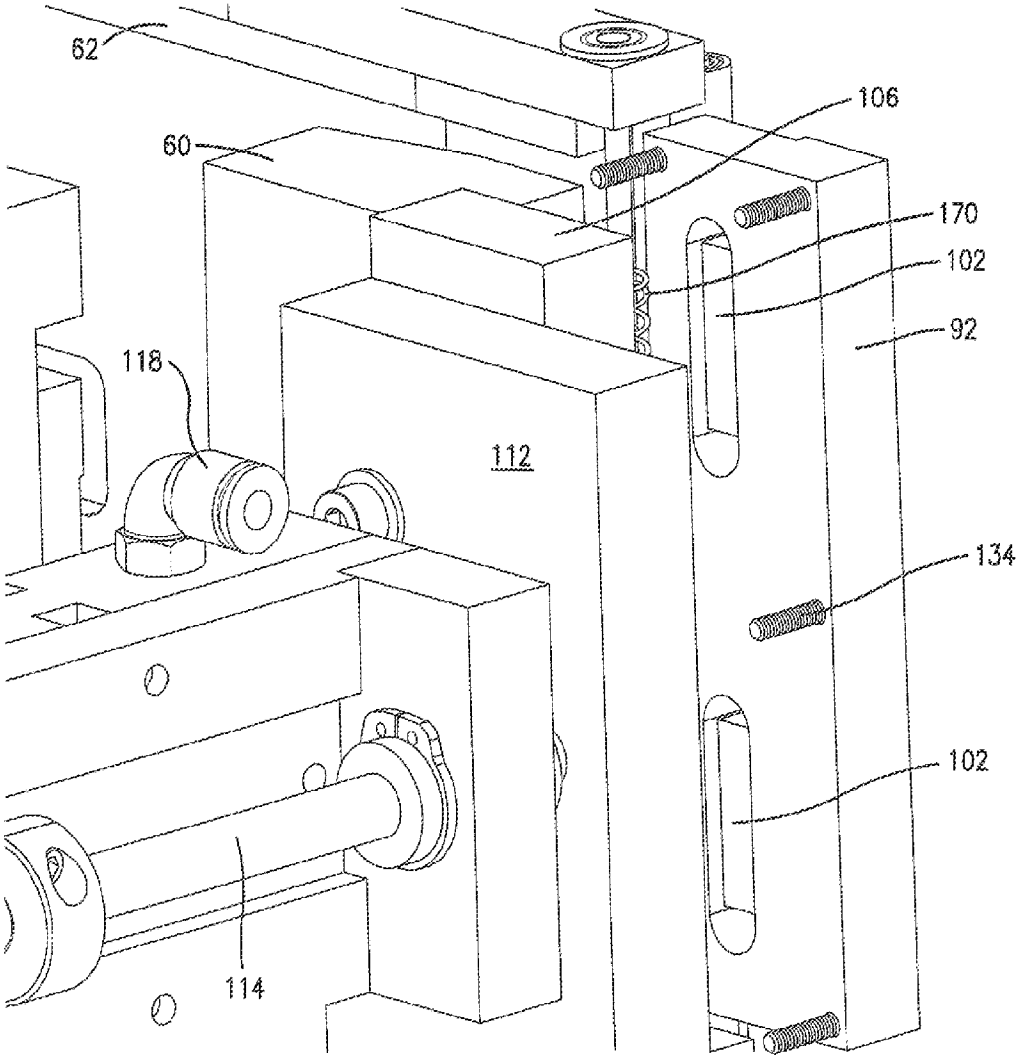
FIG. 4 is an enlarged perspective view showing the back of the applicator unit with a piece removed for ease of illustration.

As is shown in FIG. 3, tin-ties 12 are separated from liner 20 as they pass over edge 80 of peeler bar 62 (liner 20 and empty liner 24 are omitted for ease of illustration). Edge 80 is preferably made of a low surface energy material, such as Delrin plastic, and is attached to peeler bar 62 by recessed set screws 82 as is best shown in FIG. 3. Assisting in moving the tin-ties from the liner and into position for application to packaging 14, is an air assist unit 84. The air assist unit comprises a generally vertically positioned tube 86, which is connected to a source of compressed air (not shown). As is best shown in FIG. 3, tube 86 is positioned behind peeler bar 62, adjacent peeler edge 80. A series of openings or ports 88 in tube 86 direct compressed air to assist in the release of the tin-tie from the liner and positioning of the tin-tie on a tamp applicator unit 90. Actuation of the compressed air may be timed to immediately precede actuation of the tamp head through the PLC (not shown). More particularly, the tin-tie is picked up on the face 92 of front head 94 with adhesive 18 positioned away from face 92. There is a lower recessed portion 96 on the right of face 92 as seen in FIG. 3, closer to peeler bar 62, and an upper raised portion 98 on the left of face 92 as seen in FIG. 3, further from peeler bar 62, with a vertical edge 100 formed where recessed portion 96 and raised portion 98 meet. Tin-tie 12 is positioned, as illustrated in FIG. 3, in recessed portion 96 of face 92 of head 94 with a lateral edge of tin-tie 12 abutting vertical edge 100 providing a hard stop to aid in proper alignment and placement of the tin-tie. Although the front of tin-tie 12, which does not intentionally have a coating of adhesive is in contact with tamp applicator 90, head 94 is preferably made of a low surface energy material, such as high density polyethylene, or at least face 92 is silicon coated to reduce the unintentional build-up of adhesive from the tin ties.

A vacuum, conveniently applied by vacuum lines through front head 94 to face 92 could be used to carry and releaseably retain the tin-tie. A system could then rely on the adherence of the tin-tie to the packaging to overcome the vacuum and release the tin-tie from face 92; alternatively, operation of the vacuum may be synchronized to be shut off, by a conventional solenoid control, at the time that the tin-tie is being applied to the packaging in order to facilitate its release. In the preferred embodiment illustrated in the drawings, tin-tie 12 is releaseably retained on face 92 by magnets 102. The magnets are preferably rare earth permanent magnets. As illustrated, magnets 102 are generally rectangular solids positioned in spaced apart, generally vertical alignment in recesses in the back side of head 94 behind face 92. Instead of the two magnets 102, a single longer magnet could be used, or a plurality of magnets could be differently arranged, and need not be aligned. The magnets could be of a different shape, such as cylindrical or any other convenient shape. While selectively controlled electro-magnets synchronized to be shut off, by a conventional solenoid control, at the time that the tin-tie is being applied to the packaging in order to facilitate its release, might be used, they are generally too large for most for the size of tin-tie usually being applied. In the event that a synchronized assisting force is needed to facilitate release of the tin-tie at the time that the tin-tie is being applied to the packaging, a compressed air jet blower could be positioned behind the magnets. However, such an assisting force has not been found necessary in the present preferred embodiment.

In addition to front head 94, tamp applicator unit 90 includes, a middle block 104 and a back block 106, which ride on base 108. A plate 112, spaced above base 108, is connected to back block 106. The plate is advanced and retracted laterally by a shaft 114, which is carried by stationary assembly 116 for pneumatically operated axial movement between a retracted position and an extended position. More particularly compressed air is routed through fittings 118 as directed by the PLC. Liquid rather than air could be used to pneumatically operate the tamp applicator, or it could be servo or solenoid operated. In the extended position of shaft 114, plate 112, back block 106, middle block 104, head 94 and face 92 with tin-tie 12 is brought into contact with packaging 14.

If a thermoplastic, rather than pressure sensitive, adhesive is used, the tamp applicator unit could be provided with a heated tamp head for warming/softening of the adhesive to improve tack. A heated tamp head could also be used to melt the packaging material onto the tin-tie and eliminate adherence by an adhesive.

As tin-tie 12, or more particularly, the back of the tin-tie with adhesive 18 is brought into contact with packaging 14, adhesive 18 and the pressure resulting from the lateral contact exerted by tamp applicator 90 will adhere tin-tie 12 to packaging 14. This application of the tin-tie occurs in a form and fill packaging process as moving packaging material 14 comes off a form and fill tube 120 and before sealing (not shown) of the formed and filled container. More particularly, tin-tie 12 is applied to packaging 14 as it comes down off of fill tube 120 and over anvil member 122 depending down from the fill tube. Tin-tie 12 is conveniently applied on the product packaging generally opposite the fin seal on the back, although it may be applied in almost any other position with respect to the fin seal. As the tin-tie and packaging materials are both generally low surface energy materials, a portion or strip of the packaging material could be pre-treated with a corona or plasma treatment to increase adhesion by increasing surface tension or wet out. A small corona treatment unit 124, which might be obtained from Corotec Corporation, could be positioned as illustrated in FIG. 2.

In the application of a tin-tie, there is a risk of damage to the product packaging, primarily tearing, from a generally transverse impact of an adhesive backed tin-tie and an applicator head to the moving packaging. To minimize such possible tearing or other damage to the moving packaging 14 from substantially transverse contact of tin-tie 12 and face 92 of the tamp applicator, front head 94 and middle block 104 are carried for vertical relief movement relative to back block 106. Middle block 104 includes an integral lower portion 128 and an attached lower portion 132. Machine screws 134 extend from the back side 136 of front head 94, with the heads of machine screws 134 retained by front head 94, through bores, and are threadedly received and secured in threaded holes, such as 138 in integral lower portion 128 of middle block 104. Attached lower portion 132 is secured to bottom 144 of middle block 104 by machine screws 146 received and secured in threaded holes 148.

Figure 5:
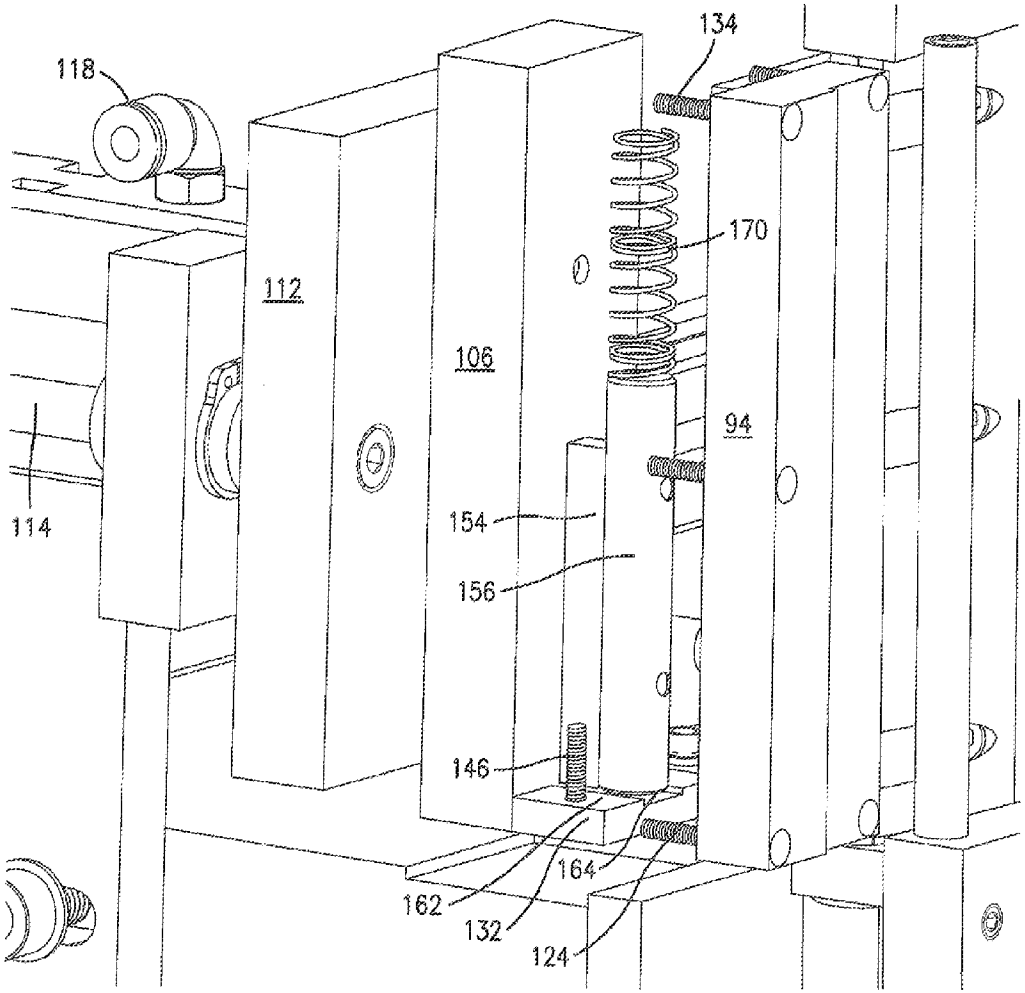
FIG. 5 is an enlarged exploded perspective view showing the applicator unit with the middle block removed for ease of illustration.
Figure 6:
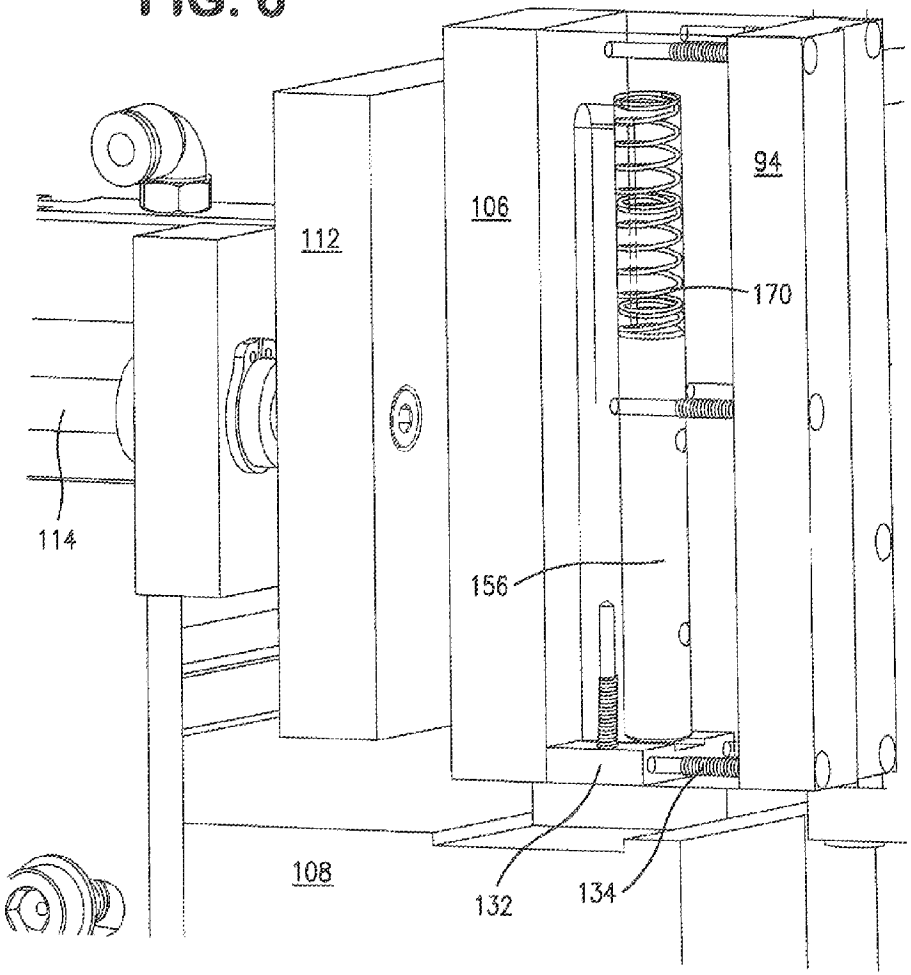
FIG. 6 is an enlarged perspective view showing the applicator unit with the middle block partially in section.
Figure 7:
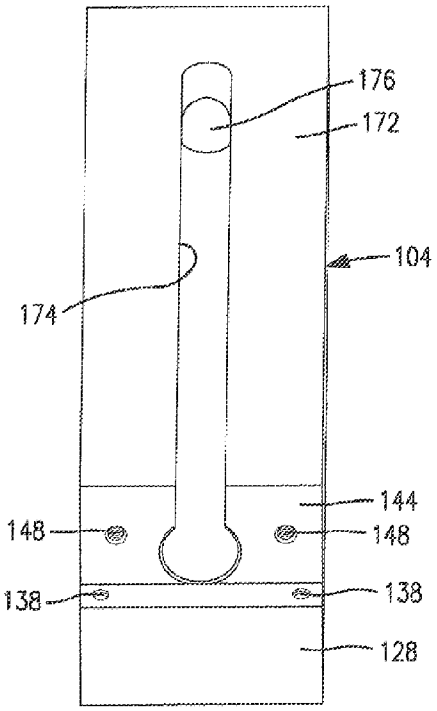
FIG. 7 is an enlarged perspective view showing the middle block piece of the applicator.

Attached to the front side 152 of back block 106 are a rib 154 and a rod 156. The bottoms of rib 154 and rod 156 abut the top 162, more particularly a shallow channel 164, of attached lower portion 132. As illustrated in FIGS. 5 and 6, rod 156 is generally cylindrical and is a little higher than middle block 104 and back block 106. Rib 154 is generally rectangular in cross-section and does not extend as high as rod 156. Positioned atop rod 156 is a compression spring 170.

In its back side 164, middle block 104 has a keyhole shaped slot 174 that extends up from bottom 144 and ends inside of middle block 104. Slot 174 slips down over spring 170, rod 156 and rib 154, with the top of spring 170 abutting the top 176 of slot 174. In its uncompressed state, spring 170 atop rod 156 supports middle block 104 and front head 94 at substantially the same vertical height as back block 106. When tamp applicator 90, more particularly front face 92 and the tin-tie it carries is extended laterally to contact downward moving packaging 14, the pressure of that contact will allow compression of spring 170 and permit middle block 104 and front head 94 to move downwardly with the packaging to instantaneously redirect the substantially transverse force of the impact and thus minimize damage to the packaging by the laterally exerted pressure. As soon as the lateral pressure is released by the retraction of shaft 114, and in turn middle block 104 and front head 94, spring 170 will bias middle block 104 and front head 94 back up to their staring position at substantially the same vertical height as back block 106, and the cycle repeats.

The vertical relief movement of the tamp face 92 and front head 94 could alternatively be pneumatically or servo or solenoid operated and controlled by the PLC. However, the spring biasing of the front face 92 and head 94 relative to the back block 106 eliminates the need for further program control in the system.

While a particular embodiment of the invention has been shown and described, alternatives, variations and modifications will occur to those skilled in the art. It is intended in the appended claims to cover all such alternatives, variations and modifications that come within the true spirit and scope of the present invention.

What is claimed as new and desired to be secured by Letters Patent is:

1. A system for applying a tin-tie to a length of packaging during a packaging process comprising:

a length of packaging material capable of moving in a first direction;

a length of liner;

a supply of adhesive backed tin-ties each having a length of malleable material releaseably adhered generally transversely along the length the liner;

a peeler having an edge generally parallel to the length of malleable material for removing a tin-tie from the liner;

a tamp applicator capable of carrying the released tin-tie removed from the liner;

the tamp applicator is capable of extending and retracting along a second direction substantially transverse to the first direction of movement of the length of the packaging material; and the tamp applicator includes a recessed portion having a leading edge generally parallel to the edge of the peeler for receiving the released tin-tie.

2. The system of claim 1 in which the tamp applicator includes a magnet for carrying the released tin-tie.

3. The system of claim 1 including a tube, capable of carrying compressed air, positioned adjacent the peeler and the tamp applicator, the tube having a plurality of openings for directing compressed air to assist in releasing a tin-tie from the liner and positioning the tin-tie on the applicator.

4. The system of claim 1 in which the recessed portion defines an edge spaced from and generally parallel to but raised from the leading edge against which one of the sides of the released tin-tie abuts to align the tin-tie.

5. The system of claim 4 including a tube, capable of carrying compressed air, positioned adjacent the peeler and the tamp applicator, the tube having a plurality of openings for directing compressed air to assist in releasing a tin-tie from the liner and positioning the tin-tie on the applicator.

6. The system of claim 4 in which the tamp applicator includes a portion capable of carrying the released tin-tie that is also moveable in the same first direction of movement of the length of the packaging material.

7. The system of claim 1 in which the tamp applicator includes a portion capable of carrying the released tin-tie that is also moveable in the same first direction of movement of the length of the packaging material.

8. The system of claim 7 in which the portion of the tamp applicator capable of carrying the released tin-tie that is also moveable in the same first direction of movement of the length of the packaging material includes a spring that is compressed to bias the portion to return in a third direction opposite to the first direction.

9. The system of claim 7 in which the portion of the tamp applicator capable of carrying the released tin-tie that is also moveable in the same first direction of movement of the length of the packaging material is carried by a piece that is capable of extending and retracting in the second direction substantially transverse to the first direction of movement of the length of the packaging material.

10. The system of claim 9 in which the portion of the tamp applicator capable of carrying the released tin-tie that is also moveable in the same first direction of movement of the length of the packaging material is carried by the piece that is capable of extending and retracting in the second direction substantially transverse to the first direction of movement of the length of the packaging material by a rib and attached rod that are secured to one of the piece or portion and received in a slot in the other of the portion or piece.

11. A system for applying a tin-tie to a length of packaging during a packaging process comprising:

a length of packaging material capable of moving in a first direction;

a length of liner;

a supply of adhesive backed tin-ties each having a length of malleable material releaseably adhered generally transversely along the length the liner;

a peeler having an edge generally parallel to the length of malleable material for removing a tin-tie from the liner;

a tamp applicator capable of carrying the released tin-tie removed from the liner;

the tamp applicator is capable of extending and retracting along a second direction substantially transverse to the first direction of movement of the length of the packaging material; and the tamp applicator includes a leading edge generally parallel to the edge of the peeler and an edge spaced from and generally parallel to but raised from the leading, edge against which one of the sides of the released tin-tie abuts to align the tin-tie.

12. The system of claim 11 including a tube, capable of carrying compressed air, positioned adjacent the peeler and the tamp applicator, the tube having a plurality of openings for directing compressed air to assist in releasing a tin-tie from the liner and positioning the tin-tie on the applicator.

13. The system of claim 11 in which the tamp applicator includes a portion capable of carrying the released tin-tie that is also moveable in the same first direction of movement of the length of the packaging material.

14. A system for applying an adhesive backed attachment to a moving packaging material during a packaging process comprising:

a length of packaging material capable of moving in a first direction;

a length of liner;

a supply of the adhesive backed attachments each having a length releaseably adhered generally transversely along the length the liner;

a peeler having an edge generally parallel to the length of each attachment for removing an adhesive backed attachment from the liner;

a tamp applicator including a portion capable of carrying the released adhesive backed attachment removed from the liner;

the tamp applicator is capable of extending and retracting along a second direction substantially transverse to the first direction of movement of the length of the packaging material;

the portion of the tamp applicator capable of carrying the adhesive backed attachment also being moveable in the same first direction of movement of the length of the packaging material; and the tamp applicator includes a leading edge generally parallel to the edge of the peeler and an edge spaced from and generally parallel to but raised from the leading edge against which a side of the released adhesive backed attachment abuts to align the released adhesive backed attachment.

15. The system of claim 14 in which the portion of the tamp applicator capable of carrying the adhesive backed attachment removed from the liner that is also moveable in the same first direction of movement of the length of the packaging material includes a spring that is compressed to bias the portion to return in a third direction opposite to the first direction.

16. The system of claim 14 in which the portion of the tamp applicator capable of carrying the adhesive backed attachment removed from the liner that is also moveable in the same first direction of movement of the length of the packaging material is carried for such movement in the same first direction by a piece that extends and retracts in the second direction substantially transverse to the first direction of movement of the length of the packaging material.

17. The system of claim 14 in which the portion of the tamp applicator capable of carrying the adhesive backed attachment removed from the liner that is also moveable in the same first direction of movement of the length of the packaging material is carried for such movement in the same first direction by the piece that extends and retracts in the second direction substantially transverse to the first direction of movement of the length of the packaging material by a rib and attached rod that are secured to one of the piece or portion and received in a slot in the other of the portion or piece.

18. A system for applying an adhesive backed attachment to a moving packaging material during a packaging process comprising:

a length of packaging material capable of moving in a first direction;

a length of liner;

a supply of the adhesive backed attachments each having a length releaseably adhered generally transversely along the length the liner;

a peeler having an edge generally parallel to the length of each attachment for removing an adhesive backed attachment from the liner;

a tamp applicator including a portion capable of carrying the released adhesive backed attachment removed from the liner;

the tamp applicator is capable of extending and retracting along a second direction substantially transverse to the first direction of movement of the length of the packaging material;

the portion of the tamp applicator capable of carrying the adhesive backed attachment also being moveable in the same first direction of movement of the length of the packaging material; and the tamp applicator includes a recessed portion having a leading edge generally parallel to the edge of the peeler for receiving the released adhesive backed attachment.

19. The system of claim 18 in which the recessed portion defines an edge spaced from and generally parallel to but raised from the leading edge against which one of the sides of the released adhesive backed attachment abuts to align the released adhesive backed attachment.

20. The system of claim 18 including a tube, capable of carrying compressed air, positioned adjacent the peeler and the tamp applicator, the tube having a plurality of openings for directing compressed air to assist in releasing a released adhesive backed attachment from the liner and positioning the released adhesive backed attachment on the applicator.

* * * * *